US006044985A

United States Patent [19]

Kao

[11] Patent Number: 6,044,985

[45] Date of Patent: Apr. 4, 2000

[54] TWO-ROW TYPE TOOL SUSPENSION RACK

[75] Inventor: Jui-Chien Kao, Tali, Taiwan

[73] Assignee: Tai E International Patent & Law Office, Taipei, Taiwan

[21] Appl. No.: 09/132,448

[22] Filed: Aug. 11, 1998

[51] Int. Cl.[7] ..... A47F 7/00; B65D 73/00; A45F 5/00

[52] U.S. Cl. ..... 211/70.6; 206/793; 294/146; 294/162

[58] Field of Search ..... 211/70.6; 206/373, 206/376, 378, 379, 493; 294/146, 159, 161, 162, 163

[56] References Cited

U.S. PATENT DOCUMENTS

| | | | |
|---|---|---|---|
| 1,712,473 | 5/1929 | McWethy | 206/378 |
| 4,586,614 | 5/1986 | Quitmann | 211/70.6 |
| 5,228,570 | 7/1993 | Robinson | 211/70.6 X |
| 5,398,823 | 3/1995 | Anders | 211/70.6 |
| 5,573,116 | 11/1996 | Zink | 211/70.6 X |
| 5,743,394 | 4/1998 | Martin | 211/70.6 X |
| 5,862,913 | 1/1999 | Chou | 211/70.6 X |
| 5,897,001 | 4/1999 | Dembicks | 211/70.6 |

*Primary Examiner*—Daniel P. Stodola
*Assistant Examiner*—Erica B. Harris
*Attorney, Agent, or Firm*—Gardee & Wynne, LLP

[57] ABSTRACT

A tool suspension rack includes an elongated flat rack body having two opposite end portions and two opposite sides, a handgrip formed on one of the two end portions of the rack body, a plurality of coupling bars formed on each of the two sides of the rack body, and two juxtaposed upright clamping pieces each having a first end portion formed on the rack body and a second end portion formed with an arcuate limiting flange facing each other.

1 Claim, 5 Drawing Sheets

TWO-ROW TYPE TOOL SUSPENSION RACK

BACKGROUND OF THE INVENTION

1. Field of the Invention

The present invention relates to a suspension rack, and more particularly to a two-row type tool suspension rack.

2. Description of the Related Art

A conventional tool suspension rack 40 in accordance with the prior art is shown in FIG. 5 and comprises a rack body 41 including a first side formed with a plurality of suspension posts 42 onto each of which one of a plurality of sockets (not shown) can be fitted, and a second side formed with a positioning portion 44 for receiving a socket driver (not shown) therein. However, the rack body 41 can be formed with the suspension posts 42 on one side thereof only such that a limited quantity of sockets can be fitted onto the rack body 41, thereby decreasing the user choice of the sockets.

The present invention has arisen to mitigate and/or obviate the disadvantage of the conventional tool suspension rack.

BRIEF SUMMARY OF THE INVENTION

In accordance with one aspect of the present invention, there is provided a tool suspension rack comprising an elongated flat rack body including two opposite end portions and two opposite sides, a handgrip formed on one of the two end portions of the rack body, a plurality of coupling bars formed on each of the two sides of the rack body, and two juxtaposed upright clamping pieces each including a first end portion formed on the rack body and a second end portion formed with a limiting flange facing each other.

Further benefits and advantages of the present invention will become apparent after a careful reading of the detailed description with appropriate reference to the accompanying drawings.

DETAILED DESCRIPTION OF THE INVENTION

Figure 1:
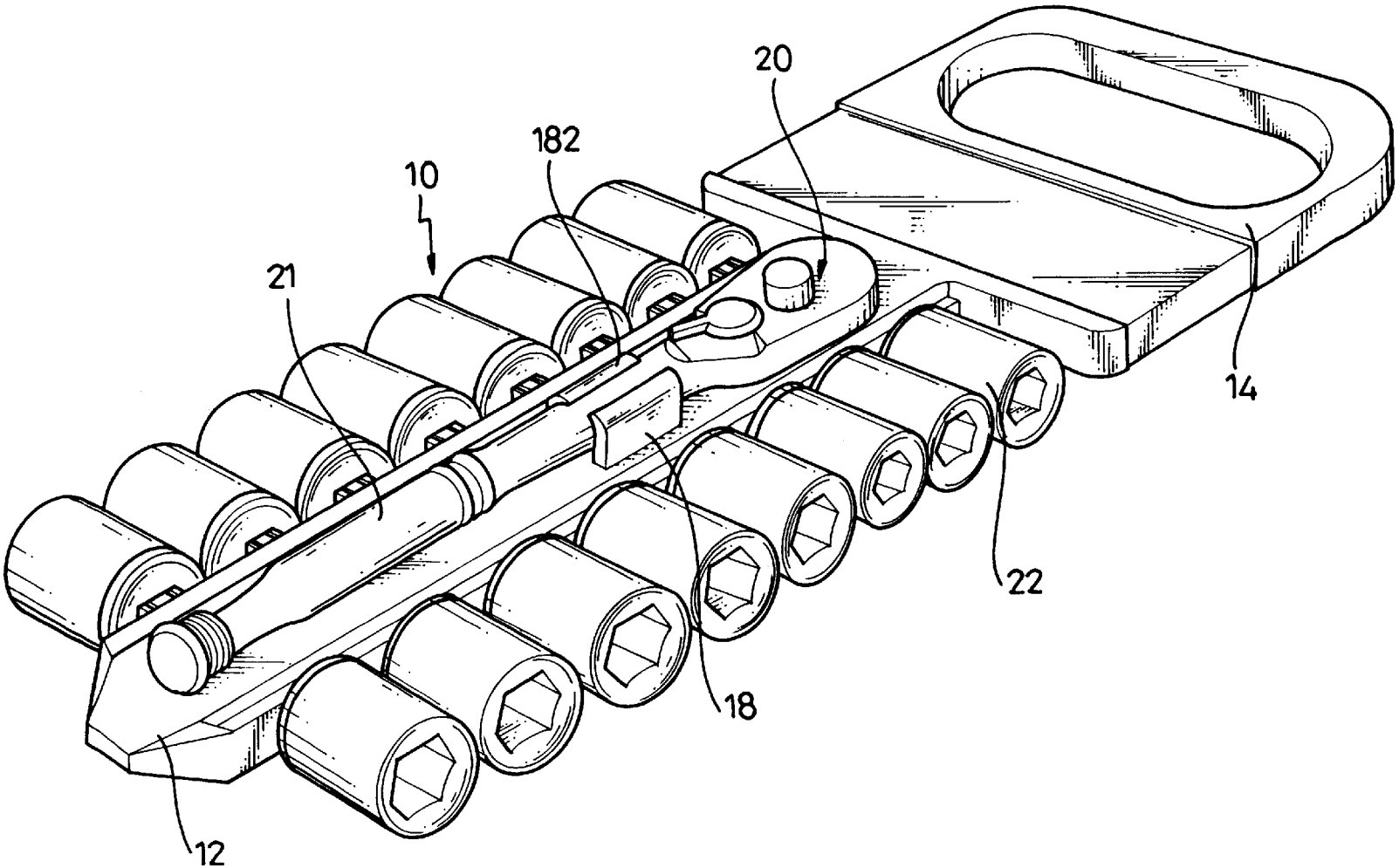
FIG. 1 is a perspective view of a tool suspension rack in accordance with the present invention.
Figure 2:
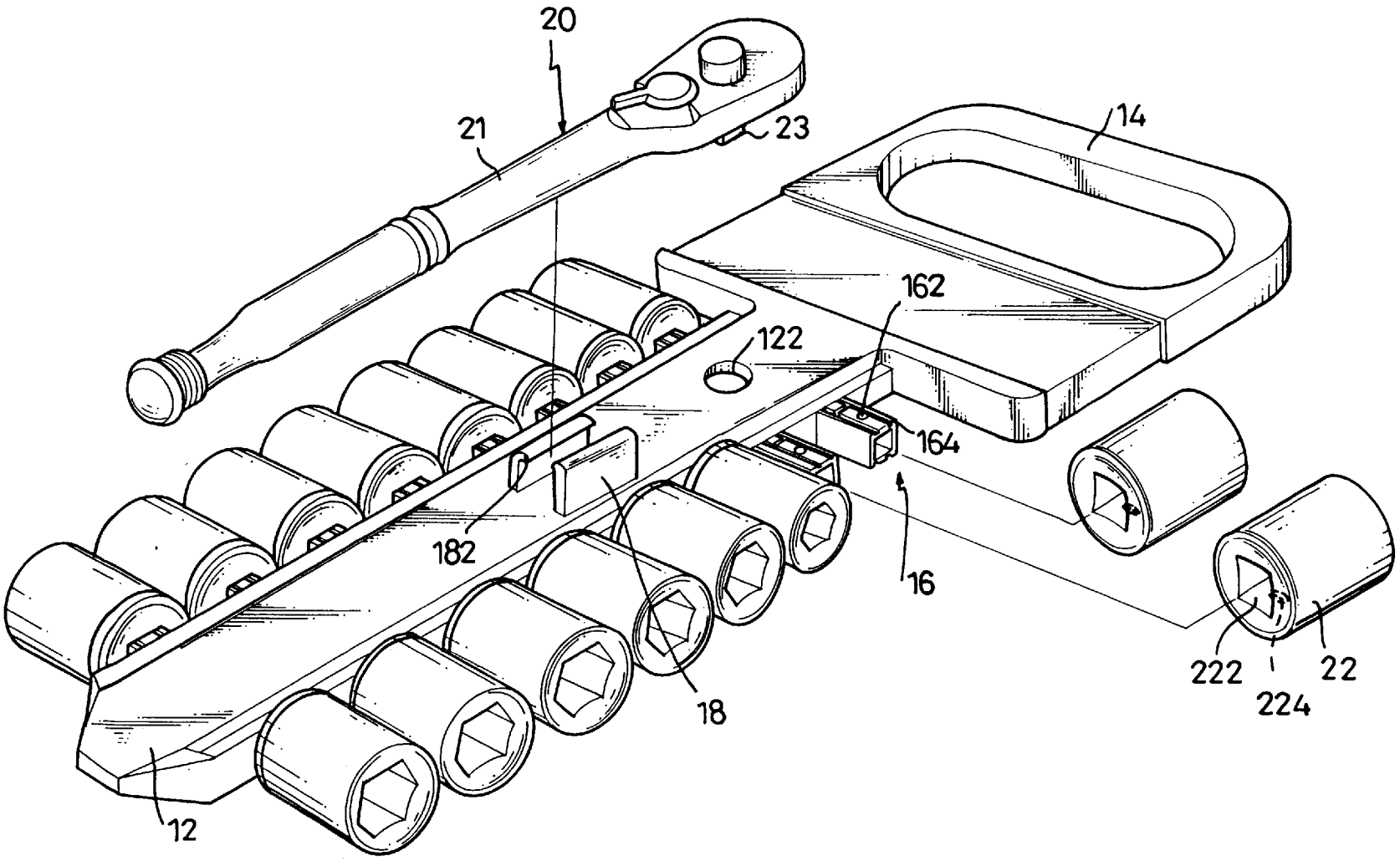
FIG. 2 an exploded view of the tool suspension rack as shown in FIG. 1.
Figure 3:
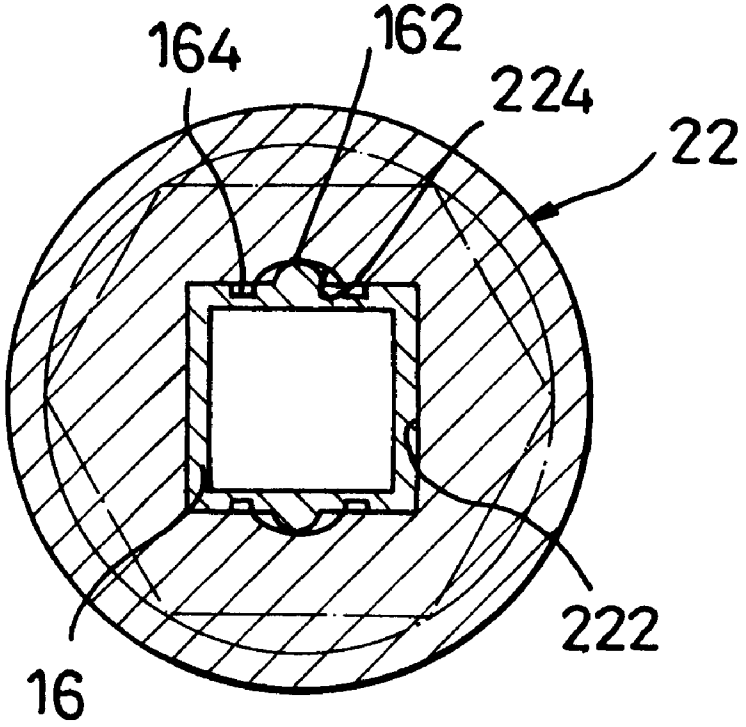
FIG. 3 is a front plan cross-sectional view of the tool suspension rack as shown in FIG. 1.

Referring to the drawings and initially to FIGS. 1–3, a two-row type tool suspension rack 10 in accordance with the present invention comprises an elongated flat rack body 12 including two opposite end portions and two opposite sides, a handgrip 14 formed on one of the two end portions of the rack body 12, a plurality of coupling bars 16 formed on each of the two sides of the rack body 12, two juxtaposed upright clamping pieces 18 each including a first end portion formed on the rack body 12 and a second end portion formed with-an arcuate limiting flange facing each other, and a receiving hole 122 in the rack body 12 and located adjacent to the two clamping pieces 18.

Each of the coupling bars 16 preferably has a tetragonal hollow body including a top wall and a bottom wall each containing two elongated grooves 164 and a boss 162 located between the two elongated grooves 164.

In assembly, the shank 21 of a socket driver 20 can be inserted into the space defined between the two clamping pieces 18, and the driving head 23 of the socket driver 20 can be received in the receiving hole 122 such that the socket driver 20 can be attached to the rack body 12 as shown in FIG. 1. The limiting flange 182 of each of the two clamping pieces 18 can be used to hold the shank 21 of the socket driver 20, thereby preventing it from being detached from the two clamping pieces 18.

One of a plurality of sockets 22 can be fitted onto a one of the corresponding coupling bars 16 and each socket contains a recess 222 for receiving the coupling bar 16, and two cavities 224 each formed in the recess 222 for receiving the boss 162 of the coupling bar 16. Each of the elongated grooves 164 can be adapted to provide the coupling bar 16 with a slight axial compressive capacity, thereby facilitating socket 22 fitted onto the coupling bar 16.

Accordingly, the two-row type tool suspension rack in accordance with the present invention comprises a rack body 12 including two sides each formed with a plurality of coupling bars 16 such that a large number of sockets 22 can be fitted onto the coupling bars 16, thereby greatly increasing the quantities of sockets 22 suspended on the suspension rack.

Figure 4:
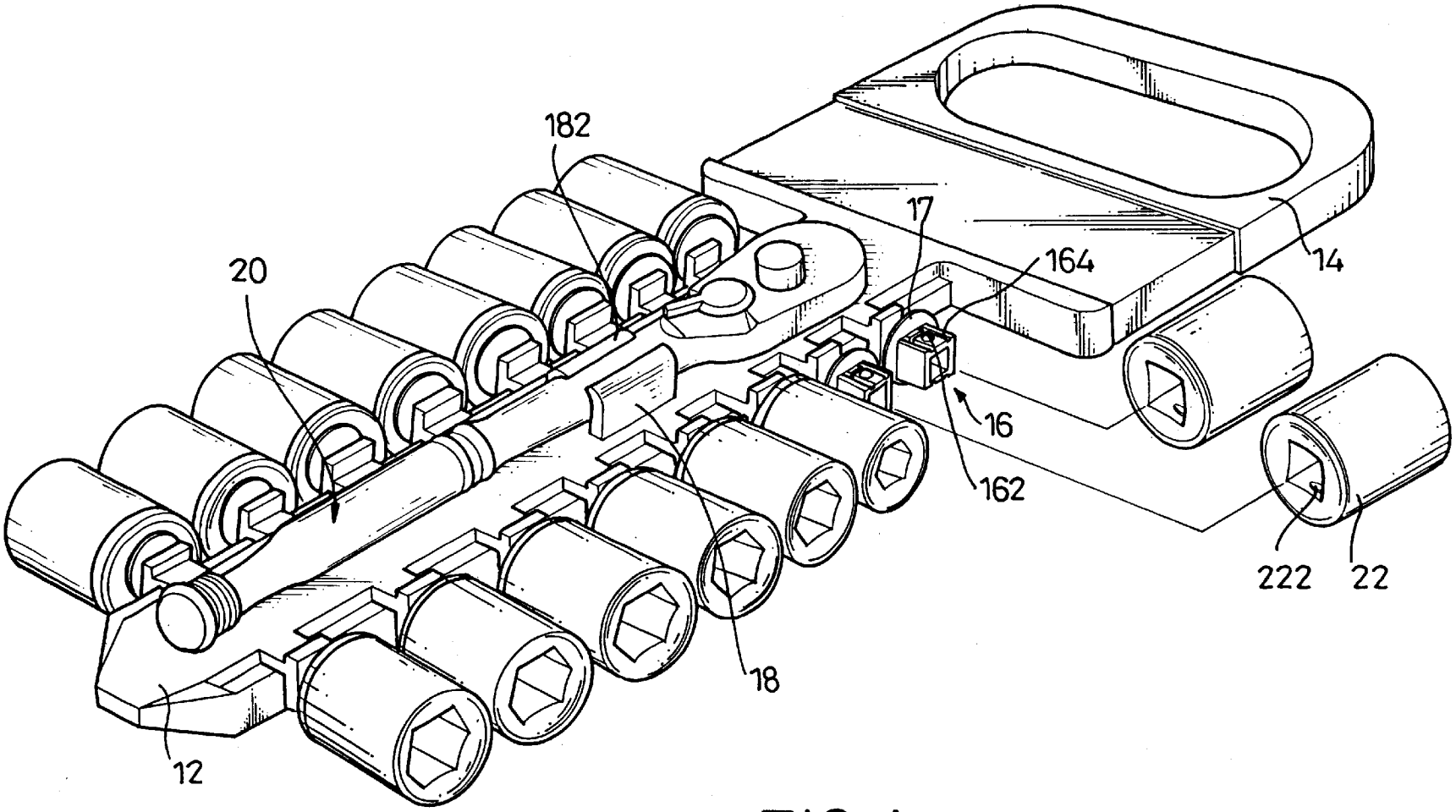
FIG. 4 is an exploded view of a tool suspension rack in accordance with a second embodiment of the present invention.
Figure 5:
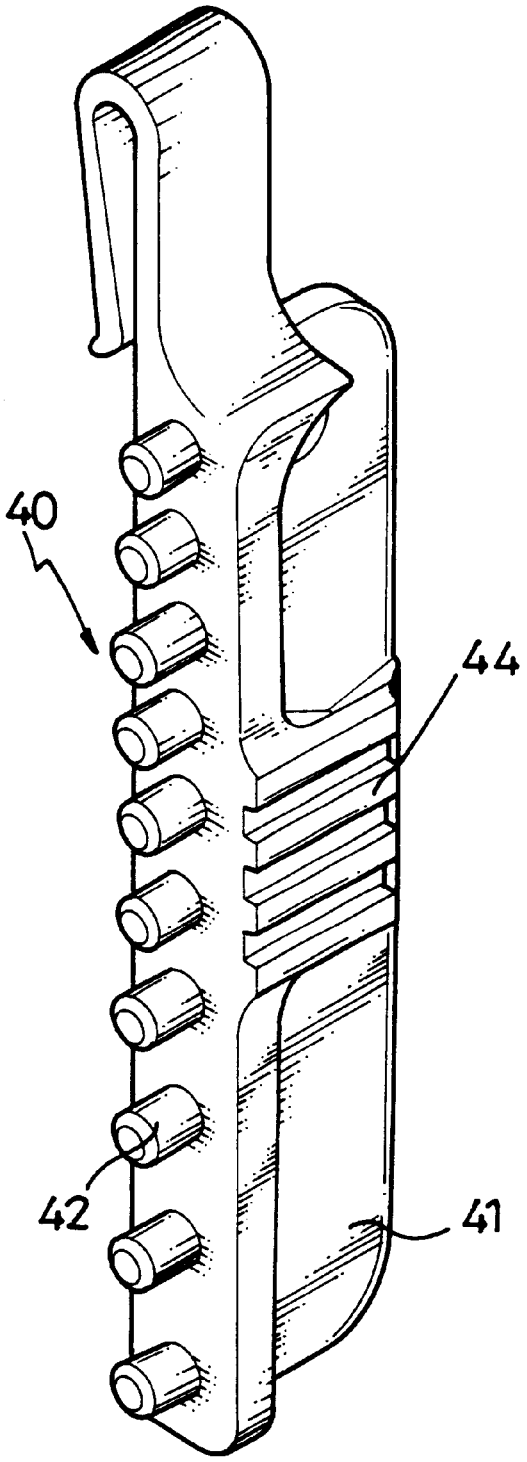
FIG.5 PRIOR ART
FIG. 5 is a perspective view of a conventional tool suspension rack in accordance with the prior art.

Referring now to FIG. 4, in accordance with a second embodiment of the present invention, each of the coupling bars 16 is formed with a circular flange 17 located adjacent to the rack body 12 for providing a positioning effect to the socket 22 when it is fitted onto the coupling bar 16.

It should be clear to those skilled in the art that further embodiments may be made without departing from the scope and spirit of the present invention.

What is claimed is:

1. A tool suspension rack comprising:

an elongated flat rack body including two opposite end portions and two opposite sides;

a handgrip formed on one of said two end portions of said rack body;

a plurality of tetragonal hollow coupling bars formed on each of said two sides of said rack body, each of said coupling bars having a first end portion and a second end portion, said first end portion located adjacent to said rack body and a circular flange formed thereon, each of said coupling bars having a top wall and a bottom wall each containing two elongated separated grooves therein and each including a boss located between said two separated elongated grooves; and two juxtaposed upright clamping pieces each including a first end portion formed on said rack body and a second end portion formed with an arcuate limiting flange facing each other.

* * * * *

UNITED STATES PATENT AND TRADEMARK OFFICE

CERTIFICATE OF CORRECTION

PATENT NO. : 6,044,985
DATED : April 4, 2000
INVENTOR(S) : Jui-Chien Kao

It is certified that error appears in the above-identified patent and that said Letters Patent is hereby corrected as shown below:

Title page,
Item [73], delete the assignee shown as "Tai-E International Patent and Law Office, Taipei, Taiwan".
No assignment was filed in this case.

Signed and Sealed this

First Day of April, 2003

JAMES E. ROGAN
*Director of the United States Patent and Trademark Office*